US006870513B2

(12) United States Patent
Deng et al.

(10) Patent No.: US 6,870,513 B2
(45) Date of Patent: Mar. 22, 2005

(54) ANTENNA MODULE

(75) Inventors: Ten-Long Deng, Taipei (TW); Hsiao-Ming Tsai, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 10/226,125

(22) Filed: Aug. 23, 2002

(65) Prior Publication Data

US 2003/0043078 A1 Mar. 6, 2003

(30) Foreign Application Priority Data

Aug. 23, 2001 (TW) ..... 90120771 A

(51) Int. Cl.[7] ..... H01Q 9/28; H01Q 1/38
(52) U.S. Cl. ..... 343/795; 343/700 MS
(58) Field of Search ..... 343/795, 702, 343/700 MS, 793; H01Q 1/38, 9/28

(56) References Cited

U.S. PATENT DOCUMENTS 5,175,418 A * 12/1992 Tanaka ..... 235/439
5,313,220 A * 5/1994 Hemmie et al. ..... 343/840
6,380,896 B1 * 4/2002 Berger et al. ..... 343/700 MS
6,509,837 B1 * 1/2003 Tuttle et al. ..... 343/795
6,593,897 B1 * 7/2003 McConnell ..... 343/841

* cited by examiner

*Primary Examiner*—Hoanganh Le
(74) *Attorney, Agent, or Firm*—Birch, Stewart, Kolasch & Birch, LLP

(57) ABSTRACT

An antenna module includes a circuit board, a differential-type amplifier, and a dipole antenna. The dipole antenna can be formed with two electrodes disposed on the circuit board. With the structure of the antenna module, a transmitting antenna can be designed by coupling the two electrodes of the dipole antenna to output terminals of the differential-type amplifier so as to transmit signals. In design of a receiving antenna, the two electrodes of the dipole antenna can be coupled to input terminals of the differential-type amplifier so as to receive signals. Further, if the main function chip has built-in differential power amplifier or differential low noise amplifier, a circuit module for wireless signal transmitting and receiving can be formed by directly coupling the dipole antenna to the differential power amplifier or the differential low noise amplifier.

9 Claims, 4 Drawing Sheets

ANTENNA MODULE

This application incorporates by reference Taiwan application Ser. No. 90120771, filed on Aug. 23, 2001.

BACKGROUND OF THE INVENTION

1. Field of the Invention

The invention relates in general to an antenna module, and more particularly to an antenna module disposed on a printed circuit hoard.

2. Description of the Related Art

As technology progresses, people are getting more and more convenient in daily life. In terms of communications between people, innovative communication products provide closer connections between people. Among these products, mobile telephones are the most popular and have been standard devices for personal communication. For a few years, a short-range radio technology, called Bluetooth, is being developed and promoted, and is aimed at simplifying communications among mobile computers, mobile phones and other portable handheld devices, and connectivity to the Internet, thus allowing a more concrete wireless network structure. From the experiment of the development of wireless communication technology, wireless links between devices wilt be substituted for the use of cabling gradually.

A wireless circuit typically includes at least a main function circuit and an antenna module. The main function circuit is used for processing signals while the antenna module is used for signal transmitting and receiving. For the requirement of miniaturization, the main function circuit and the antenna module are required to be integrated on a single chip. This integrated circuit is expected to have a specific performance. In addition, it is expected to have a reduced production cost without affecting its performance.

FIG. 1A illustrates a dipole antenna 100. The dipole antenna 100 has two electrodes, electrodes 110 and 150, and the lengths of the two electrodes are one fourth of the wavelength of an excitation signal. In order to radiate signals from the dipole antenna 100, as it is excited, signals fed into the electrodes 110 and 150 are required to be reversed in phase. That is, the signals at terminals F1 and F2 have a phase difference of 180°. In practice, for providing the signals on the two electrodes with the phase difference of 180°, different signal paths for the two electrodes can be employed, resulting in a phase delay of 180°. The following description will provide an illustration for implementation in this way.

FIG. 1B illustrates a dipole antenna, where the excitation of the antenna is achieved with a single-ended input. As shown in FIG. 1B, when an excited signal is fed though a feed-pin F, the excited signal fed to the electrode 110 is along a path greater than the path that the excited signal is fed to the electrode 150 by the difference between L1 and L2, that is, by (L1–L2), For an electromagnetic wave, multiplication of its frequency and wavelength is equal to a constant C, that is, $C=f\lambda$. Thus, if the signal fed into the antenna has a frequency of $f$ and $L1-L2=C/2f$, the phase difference between the signals fed into the two respective electrodes is of one half of the wavelength, that is, a phase difference of 180°, thus fulfilling the condition for radiation excitation.

A dipole antenna produced by a coaxial cable is illustrated in FIG. 2A. For making the dipole antenna, one can peel off a portion of the isolation layer and earth line from a coaxial cable 200 so that the core of the coaxial cable is exposed and acts as an electrode 210. The coaxial cable 200 is then covered with and coupled to a conductive casing as shown in FIG. 2A. The conductive casing is utilized as an electrode 250. It is obvious that the structure shown in FIG. 2A becomes a simple dipole antenna if the electrodes 210 and 250 are designed to have lengths of ¼ of the excited signal's wavelength. Referring to FIG. 2B, a cross-sectional view of the antenna taken along the line 2B—2B in FIG. 2A is shown, wherein the condition for being a dipole antenna is satisfied, As seen from FIG, 2B, the lengths of the electrodes 210 and 250 are equal to $\lambda/4$. During the antenna excitation, the excited signal can be fed into the core, and the earth line 290 can be grounded. Since the signals fed into the core and the earth line 290 have a phase difference of 180°, the signals fed into the electrodes 210 and 250 have a phase difference of 180°. Due to its simplicity, this method is widely used in the design of wireless circuits. Most of the mobile phones currently are designed by this method.

Before being radiated from the antenna, the signal is amplified by a power amplifier (PA). In addition, for the enhancement of the power amplifier's immunity to noise and common mode signal, the output signals of the power amplifier are designed as differential signals. That is, the power amplifier has a positive output terminal and a negative output terminal, and the magnitude of the output signal of the power amplifier is equal to the difference between the signals from the positive and negative output terminals. It should be noted that if the power amplifier outputs differential type signals, the output signals from the power amplifier must be converted into a single-ended signal when the antenna is required to be excited in a single-ended manner. A structure of a conventional antenna module for signal transmission is illustrated in FIG. 3A. The antenna module has a differential type power amplifier 320 with a positive output terminal P and a negative output terminal N, wherein the positive and negative output terminals form a differential pair. Since the antenna module is made with a coaxial cable, which is conventionally used in the industry, the output signals of the differential type power amplifier 320 are required to be converted into a single-ended signal before being fed into an antenna 370. In practice, a transformer 320 is connected between the differential type power amplifier and the antenna, for converting the differential type output signals into the single-ended signal. The transformer for this purpose is called a balun and is widely used in the industry.

On the other hand, the signal received by the antenna is a weak signal so that the received signal, before further processing, needs to be amplified by a low noise amplifier (LNA). Likewise, for the enhancement of the LNA's immunity to noise, the inputs of the LNA are designed as a differential pair. Thus, signal conversion is required to be concerned in the design of a receiving antenna. FIG. 3B shows a structure of a conventional receiving antenna module. As shown in FIG. 3B, the signal received by the antenna 370 is first converted into differential signals by the transformer 330. Next, the differential signals are fed into the LNA 340 for amplification. The LNA 340 has a positive input terminal P and a negative input terminal N. These two terminals have a phase difference of 180°, forming a differential pair to avoid interference.

For the conventional approaches described above, both the power amplifier and low noise amplifier are of differential type Thus, a transformer must be used when one of them is coupled to an antenna. From the viewpoint of a producer, the use of the transformer will unavoidably increase the production cost and reduce the product competitiveness. In addition, the transformer consumes power, thus affecting the efficiency. On the other hand, the dipole antenna made by the coaxial cable requires accurate in the length of the dipole antenna so as to achieve impedance matching. The process for achieving this is time-consuming. Besides, the coaxial-cable-made dipole antenna is not filly adaptable to a printed circuit board for circuit integration, thus giving little contribution to the circuit miniaturization.

SUMMARY OF THE INVENTION

It is therefore an object of the invention to provide an antenna module so that a dipole antenna is to be formed on a printed circuit board, thus saving the space on the printed circuit board.

It is another object of the invention to provide an antenna module so that a dipole antenna is directly coupled to either an amplifier or a main function circuit, thus reducing the production cost.

The invention achieves the above-identified objects by providing a transmitting antenna module, The transmitting antenna module includes a circuit board, a differential power amplifier, and a dipole antenna. The differential power amplifier is disposed on the circuit board and has a positive output terminal and a negative output terminal, thus forming a differential pair. In addition, the dipole antenna can be formed with two electrodes. In design, the dipole antenna can be formed directly on the circuit board so that one of the electrodes is coupled to the positive output terminal while another is coupled to the negative output terminal. Thus, the signals for the electrodes have a phase difference of 180°, thus allowing the signal to radiate from the dipole antenna.

The invention achieves the above-identified objects by providing a receiving antenna module. The receiving antenna module includes a circuit board, a differential low noise amplifier, and a dipole antenna. Disposed on the circuit board, the differential low noise amplifier has a positive input terminal and a negative input terminal, forming a differential pair. In addition, the dipole antenna can be formed with two electrodes. In design, the electrodes can be directly formed on the circuit board, and coupled to the positive input terminal and the negative input terminal respectively. For signal receiving, since the signals at the two electrodes have a phase difference of 180°, the signal received by the dipole antenna can be fed into the low noise amplifier in this way so as to output an amplified signal for further signal processing.

Further, the invention achieves the above-identified objects by providing a circuit module for wireless signal transmitting and receiving. The circuit module for wireless signal transmitting and receiving includes a circuit board, a main function chip, a transmitting antenna, and a receiving antenna. The main function chip has built-in differential power amplifier and differential low noise amplifier. The circuit module is formed by directly coupling the transmitting and receiving antennas to the differential power amplifier and the differential low noise amplifier.

Other objects, features, and advantages of the invention will become apparent from the following detailed description of the preferred but non-limiting embodiments. The description is made with reference to accompanying drawings described as follows.

DETAILED DESCRIPTION OF THE INVENTION

As mentioned above, when a conventional antenna module is used for transmitting a signal, a power amplifier of the antenna module the signal is used to amplify the signal before the signal is fed to the antenna of the antenna module. For signal receiving, a low noise amplifier is used to amplify the received signal so as to perform further processing If the power amplifier and the low noise amplifier are of differential type, two terminals of the amplifiers for coupling to the antenna have a phase difference of 180° (the characteristics of differential signals). According to the invention, the differential outputs of the power or the differential inputs of the low noise amplifier can be coupled to two electrodes of a dipole antenna, with no use of a transformer for signal conversion as illustrated in the conventional method. With the design in this way, the transformer for signal conversion between the differential signals and the single-ended signal becomes unnecessary. Thus, the production cost and the power consumption can be reduced, resulting in enhanced performance of the circuit.

Embodiment 1

Figure 1B:
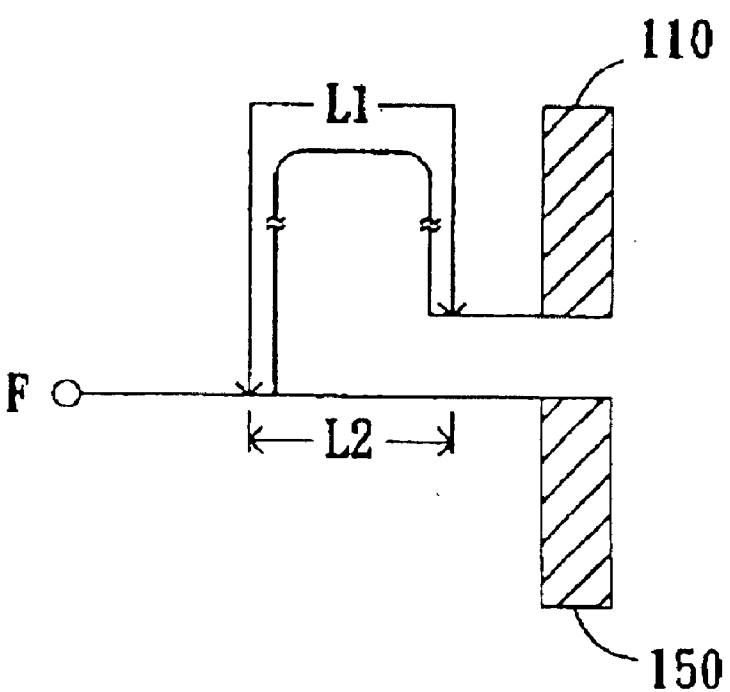
FIG. 1B(Prior Art)
FIG. 1B (Prior Art) illustrates a structure of a dipole antenna, where the excitation of the dipole antenna is achieved with a single-ended input.
Figure 1A:
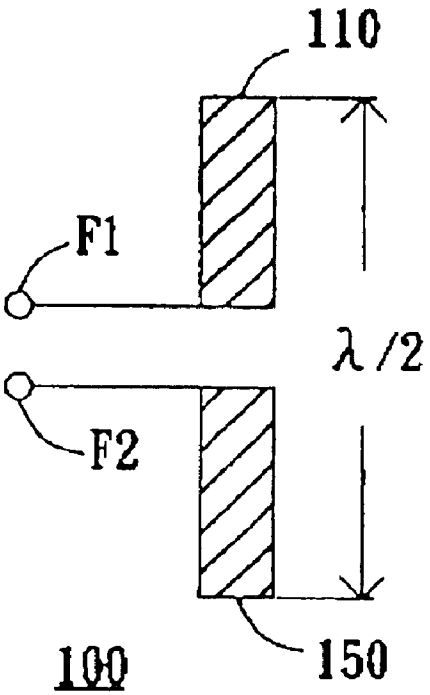
FIG. 1A(Prior Art)
FIG. 1A (Prior Art) illustrates a structure of a dipole antenna.
Figure 2A:
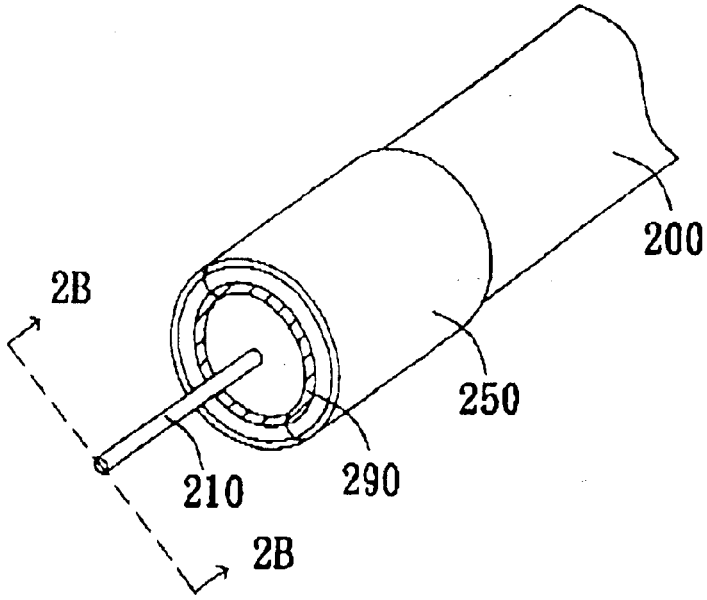
FIG. 2A(Prior Art)
FIG. 2A (Prior Art) illustrates a dipole antenna made from a coaxial cable.
Figure 2B:
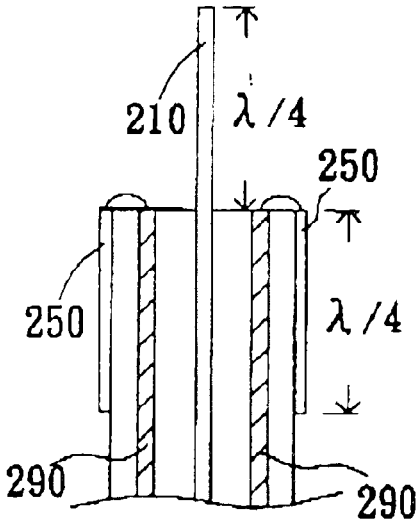
FIG. 2B(Prior Art)
FIG. 2B (Prior Art) is a cross-sectional view of the dipole antenna shown in FIG. 2A.
Figure 3A:
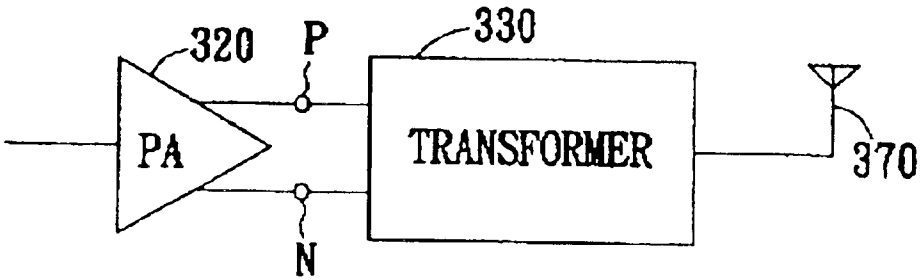
FIG. 3A(Prior Art)
FIG. 3A (Prior Art) illustrates a structure of a conventional transmitting antenna module.
Figure 3B:
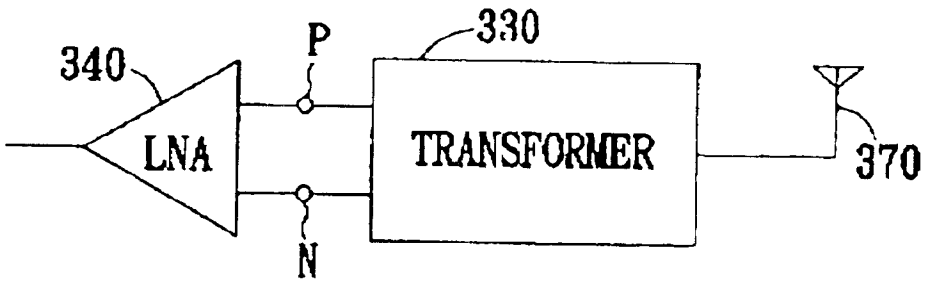
FIG. 3B(Prior Art)
FIG. 3B (Prior Art) illustrates a structure of a conventional receiving antenna module.
Figure 4A:
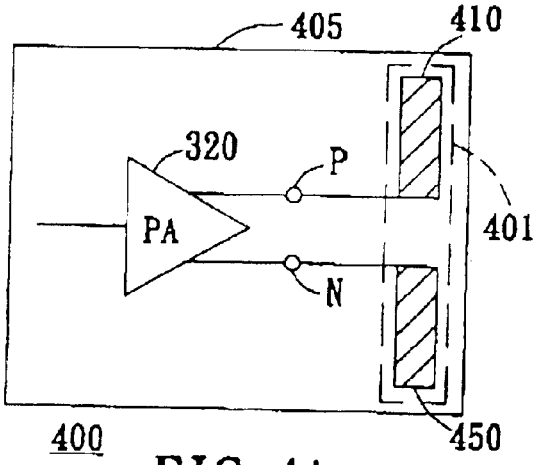
FIG. 4A illustrates a structure of an antenna module for signal transmitting according to a first embodiment of the invention.

FIG. 4A illustrates a structure of a transmitting antenna module according to a first embodiment of the invention. A transmitting antenna module 400 includes a circuit board 405, a differential power amplifier (PA) 320, and a dipole antenna 401. The differential power amplifier 320 is disposed on the circuit board 405 and has a positive output terminal P and a negative output terminal N. For signal transmission, signals at the positive output terminal P and the negative output terminal N have a phase difference of 180°, forming a differential pair so as to avoid interference. In addition, the dipole antenna 401 includes electrodes 410 and 450. The electrode 410 is coupled to the positive output terminal P while the electrode 450 is coupled to the negative output terminal N. With the connection of the power amplifier 320 and the dipole antenna 401 in this way, the signals for the electrodes 410 and 450 have a phase difference of 180°, thus allowing the signal to radiate from the dipole antenna 401. In practice, the circuit board 405 may be a printed circuit board (PCB). In addition, the electrodes 410 and 450 can be directly formed on the circuit board 405 by the technique of etching so as to be coupled to the positive output terminal P and the negative output terminal N.

Embodiment 2

Figure 4B:
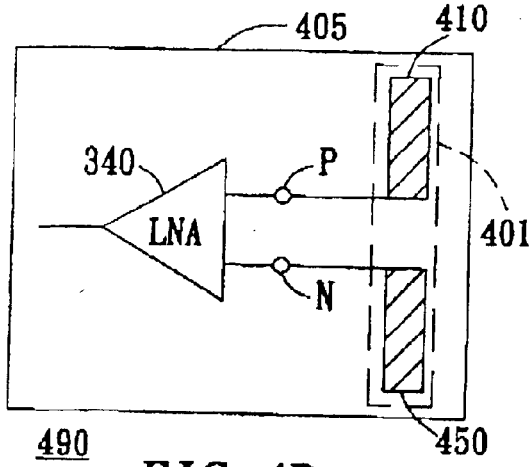
FIG. 4B illustrates a structure of an antenna module for signal receiving according to a second embodiment of the invention.

FIG. 4B is a receiving antenna module according to a second embodiment of the invention. A receiving antenna module 490 includes a circuit board 405, a differential low noise amplifier (LNA) 340, and a dipole antenna 401. The differential low noise amplifier 340 is disposed on the circuit board 405, and has a positive input terminal P and a negative input terminal N. The positive input terminal P and negative input terminal N form a differential pair. In addition, the dipole antenna 401 includes electrodes 410 and 450. In practice, the electrodes 410 and 450 can be directly formed on the circuit board 405, and are coupled to the positive input terminal P and the negative input terminal N respectively. For signal receiving, since the signals at the electrodes 410 and 450 have a phase difference of 180°, the signal received by the dipole antenna 401 can be fed into the low noise amplifier 340 in this way so as to output an amplified signal for further signal processing.

Embodiment 3

Figure 5:
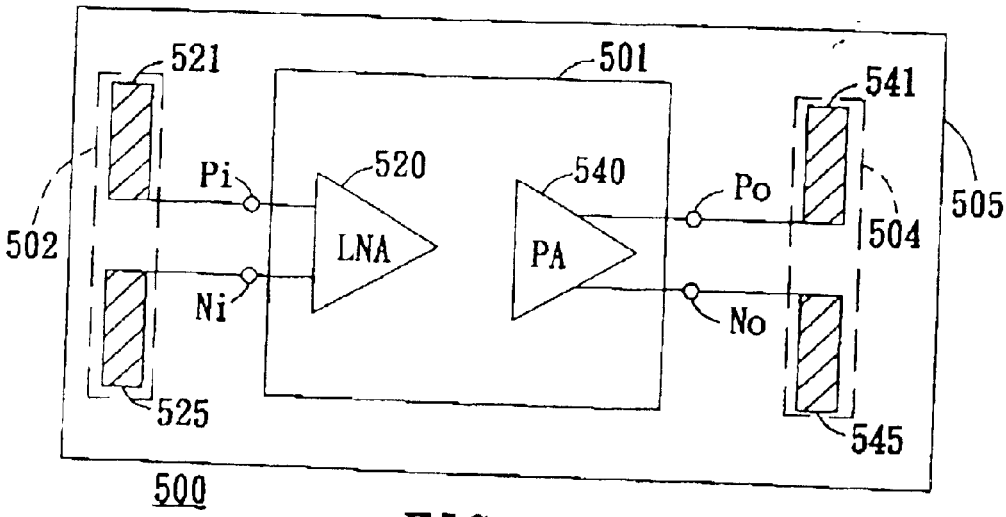
FIG. 5 illustrates a structure of a circuit module for signal transmitting and receiving according to a third embodiment of the invention.

Fully-integrated, a single chip including a power amplifier and a low noise amplifier has been available in the market, such as chips compliant to Bluetooth (or called a Bluetooth chip). Therefore, in design of a circuit module according to the invention for wireless signal transmitting and receiving, a single integrated chip, such as a Bluetooth chip, can be employed directly during the layout for the circuit module and formed on a circuit board of the circuit board. FIG. 5 is an illustration of a circuit module for signal transmitting and receiving, according to a third embodiment of the invention. A circuit module 500 includes a circuit board 505, a main function chip 501, a receiving antenna 502, and a transmitting antenna 504. The main function chip 501, such as a Bluetooth chip, is disposed on the circuit board 505, and includes a differential low noise amplifier 520 and a differential power amplifier 540. The differential low noise amplifier 520 has two differential input terminals: a positive input terminal Pi coupled to an electrode 521 of the receiving antenna 502, and a negative input terminal Ni coupled to an electrode 525 of the receiving antenna 502. In addition, the differential power amplifier 540 has two differential output terminals: a positive output terminal Po coupled to an electrode 541 of the transmitting antenna 504, and a negative output terminal No coupled to an electrode 545 of the transmitting antenna 504. During manufacturing, the receiving antenna 502 and transmitting antenna 504 can be directly formed on the circuit board 505 such as a printed circuit board. As to the operations of signal receiving and transmitting, they have been mentioned in the above and will not described for the sake of brevity.

The antenna modules disclosed in the embodiments of the invention have at least the following advantages (1) Space is saved because the dipole antenna is employed instead of the coaxial-cable-made dipole antenna and can be directly formed on the printed circuit board. (2) The production cost can be reduced since the dipole antenna is coupled to the amplifier and the main function chip directly without using the transformer for signal conversion.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A circuit module for wireless signal transmitting and receiving, comprising:

a circuit board;

a main function chip disposed on the circuit board, the main function chip comprising:

a differential power amplifier disposed on the circuit board, wherein the differential power amplifier has a positive output terminal and a negative output terminal, and the positive output terminal and the negative output terminal form a differential pair providing output differential signals to be radiated; and a differential low noise amplifier disposed on the circuit board, wherein the differential low noise amplifier has a positive input terminal and a negative input terminal, and the positive input terminal and the negative input terminal form a differential pair;

a transmitting dipole antenna, formed on the circuit board and coupled to the differential power amplifier, the transmitting dipole antenna comprising:

a first electrode formed on the circuit board and coupled to the positive output terminal; and a second electrode formed on the circuit board and coupled to the negative output terminal, wherein the output differential signals are radiated from the first and second electrodes; and a receiving dipole antenna, formed on the circuit board and coupled to the differential low noise amplifier, the receiving dipole antenna comprising:

a third electrode formed on the circuit board and coupled to the positive input terminal; and a fourth electrode formed on the circuit board and coupled to the negative input terminal, wherein a wireless signal is received by the receiving dipole antenna in the form of differential signals at the third and fourth electrodes respectively and the differential signals are fed into the positive and negative input terminals of the differential low noise amplifier.

2. The circuit module of claim 1, wherein the main function chip is a Bluetooth chip.

3. The circuit module of claim 1, wherein the circuit board is a printed circuit board.

4. A dipole antenna, coupled to a functional device, wherein the functional device is disposed on a circuit board and has a positive terminal and a negative terminal, and the positive terminal and the negative terminal form a differential pair, the dipole antenna comprising:

a first electrode formed on the circuit board and coupled to the positive terminal; and a second electrode formed on the circuit board and coupled to the negative terminal;

wherein the functional device is a main function chip comprising a differential power amplifier and a differential low noise amplifier.

5. The dipole antenna of claim 4, wherein the positive terminal is a positive input terminal of the differential power amplifier, and the negative terminal is a negative input terminal of the differential power amplifier.

6. The dipole antenna of claim 4, wherein the positive terminal is a positive output terminal of the differential low noise amplifier, and the negative terminal is a negative output terminal of the differential low noise amplifier.

7. The dipole antenna of claim 4, wherein the main function chip is a Bluetooth chip.

8. The dipole antenna of claim 4, wherein the circuit board is a printed circuit board.

9. The dipole antenna of claim 4, wherein the first electrode and the second electrode are formed on the circuit board by etching.

* * * * *